US007775185B2

(12) United States Patent
Tashiro

(10) Patent No.: US 7,775,185 B2
(45) Date of Patent: Aug. 17, 2010

(54) LIFT AMOUNT ADJUSTING DEVICE IN LIFT-VARIABLE VALVE-OPERATING MECHANISM

(75) Inventor: Masahiko Tashiro, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 424 days.

(21) Appl. No.: 12/026,904

(22) Filed: Feb. 6, 2008

(65) Prior Publication Data

US 2008/0190390 A1 Aug. 14, 2008

(30) Foreign Application Priority Data

Feb. 6, 2007 (JP) ..... 2007-26429

(51) Int. Cl.
*F01L 1/34* (2006.01)

(52) U.S. Cl. ..... 123/90.16; 123/90.39; 74/559

(58) Field of Classification Search ..... 123/90.15, 123/90.16, 90.39, 90.55, 90.52; 74/559, 74/569

See application file for complete search history.

(56) References Cited

U.S. PATENT DOCUMENTS 6,959,674 B2 11/2005 Fischer
7,204,216 B2 * 4/2007 Ezaki ..... 123/90.16
2004/0168661 A1 9/2004 Fischer

FOREIGN PATENT DOCUMENTS

DE 4208335 A1 9/1993
DE 102005019282 A1 11/2006
JP 2004-521235 A 7/2004
WO 02-95193 A1 11/2002

OTHER PUBLICATIONS

European Search Report with a date of completion of the search of Jun. 4, 2008, issued in corresponding European Patent Application No. 08001431.

* cited by examiner

*Primary Examiner*—Zelalem Eshete
(74) *Attorney, Agent, or Firm*—Westerman, Hattori, Daniels & Adrian, LLP

(57) ABSTRACT

In a lift amount adjusting device in a valve-operating mechanism which changes at least a lift amount, a rocker arm is rockably arranged in a driving-force transmitting path for transmitting a driving force of a valve cam to an engine valve, and a jig abuts on the rocker arm to establish a rocking fulcrum in place of a hydraulic tappet which generates an urging force for adjusting a clearance of the driving-force transmission path. Even when an engine is stopped to make the hydraulic tappet inoperative, the jig secures a rocking fulcrum of the rocker arm, thereby enabling adjustment of the lift amount of the intake valve. Also, a load acting on the rocker arm during the adjustment of a lift amount of the intake valve is supported by the jig, and is not transmitted to the hydraulic tappet.

7 Claims, 13 Drawing Sheets

LIFT AMOUNT ADJUSTING DEVICE IN LIFT-VARIABLE VALVE-OPERATING MECHANISM

TECHNICAL FIELD

The present invention relates to a valve-operating mechanism which changes at least a lift amount comprising a rocker arm rockably arranged in a driving-force transmitting path which transmits a driving force of a valve cam to an engine valve, and a hydraulic tappet which adjusts a clearance of the driving-force transmission path by urging the rocker arm. Particularly, the present invention relates to a lift amount adjusting device of the valve-operating mechanism which changes at least a lift amount.

BACKGROUND OF THE INVENTION

Japanese Patent Publication No. 2004-521235 discloses a lift-variable valve-operating mechanism in which a cam shaft 3 and a gas exchange valve (engine valve) 4 are connected through a rotating lever (subsidiary cam) 21 and a cam lever (rocker arm) 5, and a relationship of a lift amount of the gas exchange valve 4 with respect to a phase of the cam shaft 3 is made variable by changing a position of a rocking fulcrum of the rotating lever 21 by a controller 25. In this mechanism, one end of the cam lever 5 abuts a stem end of the gas exchange valve 4 and the other end thereof is urged by a liquid-pressure-type valve-clearance compensating element (hydraulic tappet) 7, thereby adjusting a clearance of a driving-force transmission path extending from the cam shaft 3 to the gas exchange valve 4.

In this type of lift-variable valve-operating mechanism, it is important to appropriately adjust the lift amount of the engine valve, but the adjustment can be made only while an internal combustion engine is stopped. However, if the internal combustion engine is stopped, a hydraulic pump driven by a crankshaft is also stopped, bringing the hydraulic tappet into an inoperative state. As a result, the rocking fulcrum of the rocker arm becomes unstable, leading to a problem that adjustment of the lift amount becomes impossible.

In order to solve this problem, in the mechanism described in Japanese Patent Publication No. 2004-521235, an outer peripheral groove 15 is formed at the tip end of a piston 6 in a liquid-pressure-type valve-clearance compensating element (hydraulic tappet) 7; a fork-shaped end portion 9' of a tool 9 is engaged with the outer peripheral groove 15; and the fork-shaped end portion 9' is pulled by a tension spring 16. With this arrangement, even in a state where liquid pressure is not supplied to the liquid-pressure-type valve-clearance compensating element 7, it is possible to adjust the clearance of the driving-force transmission path extending from the cam shaft 3 to the gas exchange valve 4, thereby adjusting the lift amount of the engine valve.

However, the mechanism described in Japanese Patent Publication No. 2004-521235 requires the outer peripheral groove 15 to be formed at the tip end of the piston 6 of the liquid-pressure-type valve-clearance compensating element 7 so that the outer peripheral groove 15 can be engaged with the fork-shaped end portion 9' of the tool 9. Thus, in order to compensate for a lowered strength of the piston 6 due to formation of the outer peripheral groove 15, it is disadvantageously required to increase the size or wall thickness of the piston, and also there is a concern that the piston 6 is twisted by the tool 9 to lower durability of the liquid-pressure-type valve-clearance compensating element 7.

SUMMARY OF THE INVENTION

The present invention has been achieved in view of the above-described circumstances, and has an object to adjust a lift amount of an engine valve without an excessive load acting on a hydraulic tappet even in a state in which hydraulic pressure is not supplied to the hydraulic tappet.

To achieve the above object, according to the present invention, there is provided a lift amount adjusting device in a valve-operating mechanism which changes at least a lift amount, the valve-operating mechanism comprising: a valve cam; an engine valve; a driving-force transmitting path which transmits a driving force of the valve cam to the engine valve; a rocker arm rockably arranged in the driving-force transmitting path; and a hydraulic tappet which adjusts a clearance of the driving-force transmission path by urging the rocker arm, the lift amount adjusting device comprising a jig which abuts the rocker arm to establish a rocking fulcrum in place of the hydraulic tappet.

With the above structure, the rocker arm is rockably disposed in the driving-force transmitting path which transmits a driving force of the valve cam to the engine valve, and the jig is provided for establishing a rocking fulcrum in place of the hydraulic tappet which generates an urging force for automatically adjusting the clearance of the driving-force transmission path. Therefore, even when an engine is stopped, making the hydraulic tappet inoperative, the jig secures a rocking fulcrum of the rocker arm, thereby enabling adjustment of the lift amount of the intake valve. Also, a load acting on the rocker arm during the adjustment of the lift amount of the intake valve is supported by the jig, and is not transmitted to the hydraulic tappet. Thus, the hydraulic tappet can be protected from damage without being particularly reinforced, thereby contributing to downsizing and improvement in durability of the hydraulic tappet.

Also, according to the present invention, the rocking fulcrum is established by engagement between a projection provided in the rocker arm and a receiving portion provided in the jig.

With this structure, the rocking fulcrum in place of the hydraulic tappet is established by engagement between the projection provided in the rocker arm and the receiving portion provided in the jig. Therefore, the rocker arm can be reliably pivotally supported so that the rocker arm does not slip.

Further, according to the present invention, the projection and the receiving portion comprise arc-shaped faces which are rockably engaged with each other; and a center of the arc-shaped faces and a center of a spherical projection at a tip end of a piston of the hydraulic tappet are aligned with each other when seen in a direction orthogonal a rocking face of the rocker arm.

With this structure, the projection of the rocker arm and the receiving portion of the jig comprises arc-shaped faces rockably engaged with each other, and the center of the arc faces and the center of the spherical projection at the tip end of the piston in the hydraulic tappet are aligned with each other when seen in a direction orthogonal the rocking face of the rocker arm. Therefore, the rocker arm can rock around the same rocking center as that in the case where it is pivotally supported by the piston of the hydraulic tappet, thereby improving accuracy in adjustment of the lift amount of the engine valve.

Still further, according to the present invention, the valve-operating mechanism includes a control arm which rockably supports a subsidiary cam and the rocker arm, and the jig is mounted to the control arm.

With this structure, the jig is mounted on the control arm rockably supporting the subsidiary cam and the rocker arm of the valve-operating mechanism. Therefore, the positional relationship between the jig and the rocker arm is made constant, thereby pivotally supporting the rocker with a good accuracy.

Still further, according to the present invention, the control arm includes a plurality of rocker-arm accommodating holes for accommodating a plurality of rocker arms; and the jig abuts the plurality of rocker arms and is mounted so as to provide connection between sidewalls of the plurality of rocker-arm accommodating holes.

With this feature, the control arm includes the plurality of rocker-arm accommodating holes that accommodate the plurality of rocker arms, and the jig abutting on the plurality of rocker arms are mounted so as to connect the sidewalls of the plurality of rocker-arm accommodating holes to each other. Thus, the jig enhances the rigidity of the control arm, thereby preventing distortion of the control arm to improve the accuracy in adjustment of the lift amount of the engine valve.

Still further, according to the present invention, the jig has a notch for avoiding interference with an ignition plug guide cylinder.

With this feature, the notch is provided in the jig for avoiding interference between the jig and the ignition-plug guide cylinder, thereby enabling the mounting of the jig without any problem in a small space in the periphery of the valve-operating mechanism.

Still further, according to the present invention, the jig abuts a weight member slidably fitted in the ignition plug guide cylinder to urge the rocker arm in a direction to adjust the clearance of the driving-force transmission path.

With this structure, the weight member slidably fitted in the ignition-plug guide cylinder is brought into abutment with the jig to urge the rocker arm in the direction to adjust the clearance of the driving-force transmission path. Therefore, the clearance is reliably adjusted by a constant urging force of the weight member, thereby improving the accuracy in adjustment of the lift amount in the engine valve.

The above-mentioned object, other objects, characteristics, and advantages of the present invention will become apparent from preferred embodiments, which will be described in detail below by reference to the attached drawings.

BRIEF DESCRIPTION OF THE DRAWINGS

FIGS. 1 to 11 show a first embodiment of the present invention wherein

FIG. 1 is a longitudinal side view of an essential part of an internal combustion engine;

FIG. 2 is a view taken in the direction of an arrow line 2-2 of FIG. 1;

FIG. 3 is a sectional view taken along a line 3-3 of FIG. 2 in a high valve-lift state;

FIG. 4 is a sectional view taken along a line 4-4 of FIG. 2 in the high valve-lift state;

FIG. 5 is a sectional view in the low valve-lift state, corresponding to FIG. 4;

FIG. 6 is a view corresponding to FIG. 1 and showing a state where a jig is mounted;

FIG. 7 is a view taken in the direction of an arrow line 7 of FIG. 6;

FIG. 8 is an enlarged sectional view taken along a line 8-8 of FIG. 6;

FIG. 9 is an enlarged sectional view taken along a line 9-9 of FIG. 6;

FIG. 10 is an enlarged view of a part 10 of FIG. 6; and

FIG. 11 is a perspective view of the jig.

FIGS. 12 and 13 show a second embodiment of the present invention wherein FIG. 12 is a view corresponding to FIG. 6 and showing the second embodiment; and FIG. 13 is a perspective view showing an ignition plug guide cylinder and a weight member.

DESCRIPTION OF THE PREFERRED EMBODIMENTS

First, the structure of a lift-variable valve-operating mechanism of an internal combustion engine according to the embodiments of the present invention will be described.

Figure 1:
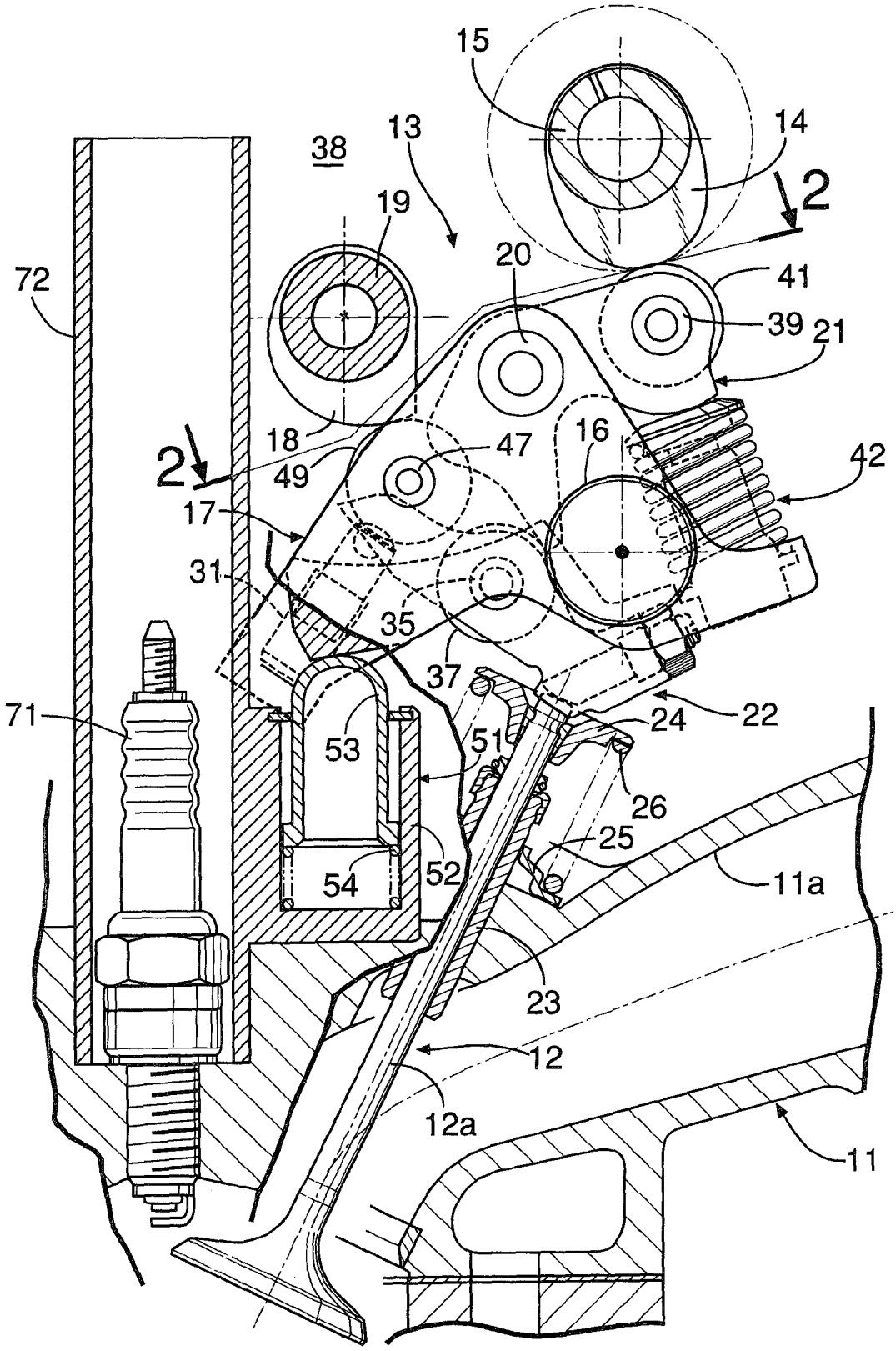
Figure 2:
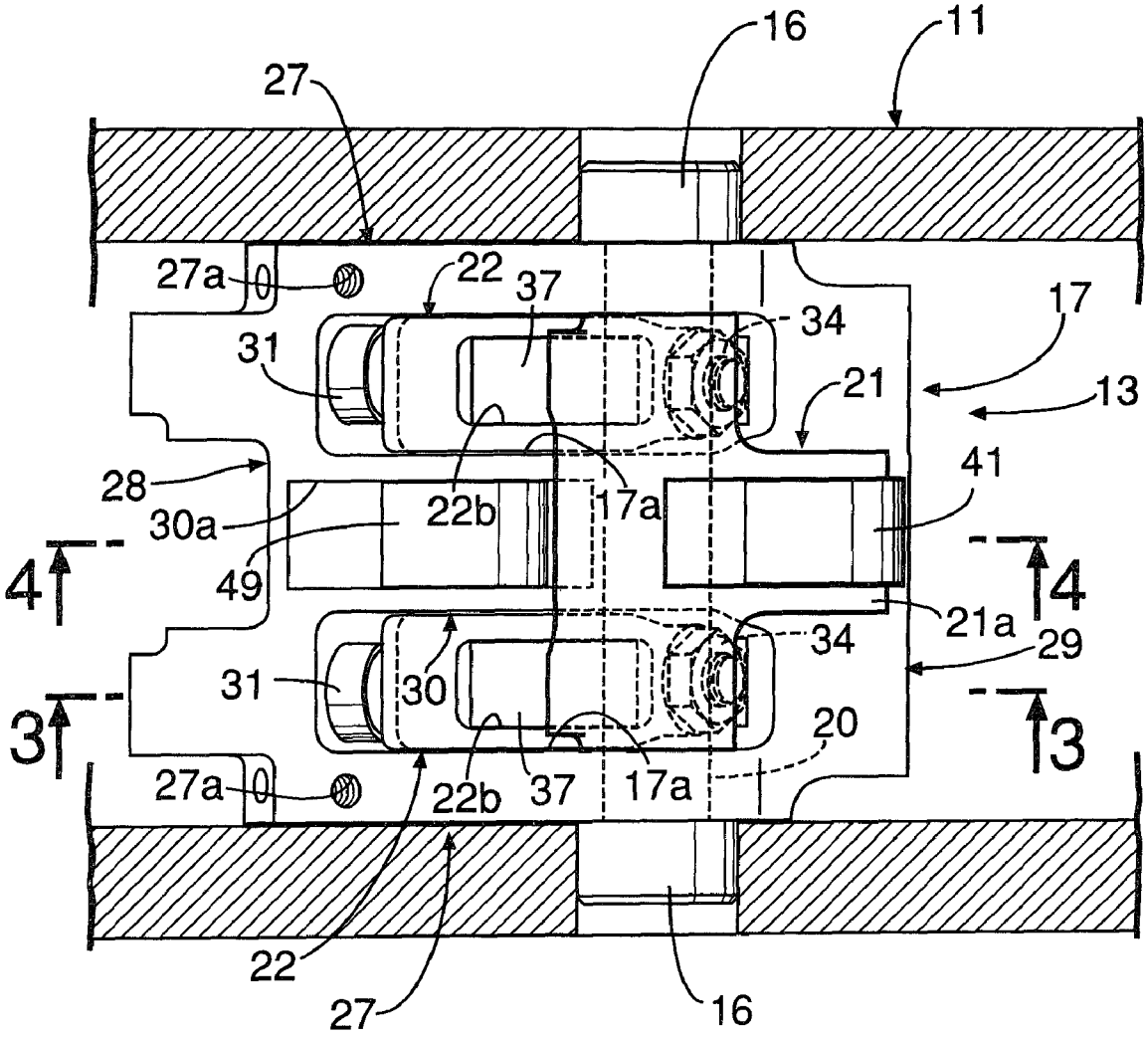

As shown in FIGS. 1 and 2, a pair of intake valves 12, 12 are disposed in a cylinder head 11 of an internal combustion engine so that the intake valves 12, 12 can open and close intake ports 11*a*, 11*a* for respective cylinders. A lift-variable valve-operating mechanism 13 is provided in a valve chamber 38 so as to open and close the intake valves 12, 12. The lift-variable valve-operating mechanism 13 comprises: a cam shaft 15 having a valve cam 14; a control arm 17 rockably supported in the cylinder head 11 through support shaft portions 16, 16; a control shaft 19 having a control cam 18 for rocking the control arm 17; a subsidiary cam 21 rockably supported by the control arm 17 through a movable support shaft 20 so as to rock following the valve cam 14; and a pair of rocker arms 22, 22 individually operably connected to the intake valves 12, 12, and respectively operated following the subsidiary cam 21. The operation characteristics including the valve lift of the intake valves 12, 12 can be changed by displacing the movable support shaft 20.

Stems 12*a*, 12*a* of the intake valves 12, 12 are slidably fitted in guide cylinders 23, 23 disposed in the cylinder head 11. The intake valves 12, 12 are urged in a direction to close the valve-closing by valve springs 26, 26 which are interposed between retainers 24, 24 which are provided at the upper ends of the stems 12*a*, 12*a* and retainers 25, 25 abutting on the cylinder head 11.

The control arm 17 comprises a single member including a pair of plate-state sidewalls 27, 27 in which the pair of support shaft portions 16, 16 are provided, respectively. The sidewalls 27, 27 are arranged in parallel with a predetermined space therebetween. The sidewalls 27, 27 are connected to each other at their one ends by an end wall 28 extending in parallel with the support shaft portions 16, 16, and at the other ends by a connecting wall portion 29 extending in parallel with the support shaft portions 16, 16. Also, the end wall 28 and the connecting wall portion 29 are integrally connected to each other by a bulkhead portion 30.

As apparent from FIGS. 1 to 4, the pair of sidewalls 27, 27 and the bulkhead portion 30 extend in parallel with each other, and two rocker-arm accommodating holes 17*a*, 17*a* are formed therebetween. Each rocker arm 22 accommodated in the rocker-arm accommodating hole 17*a* is of a type not having a rocker shaft. A spherical recess 22*a* (see FIG. 3) is formed at one end of the rocker arm 22 so as to be rockably supported at the tip end of a hydraulic tappet 31 which is attached to a hydraulic tappet mounting hole 28*a* in the end wall 28, while the other end of the rocker arm 22 drives the intake valve 12. That is, a valve driving member 32, which abuts the upper end of the stem 12*a* of the intake valve 12, is slidably supported on the other end of the rocker arm 22. The position of the valve driving member 32 can be adjusted by an adjust screw 33 and a lock nut 34, thereby adjusting a seated state of the intake valve 12. A roller accommodating hole 22*b* is formed in an intermediate portion of each rocker arm 22. A roller shaft 35 extends over the roller accommodating hole 22*b*. A roller 37 is rotatably supported on the roller shaft 35 via a needle bearing 36.

The hydraulic tappet 31 comprises a cylindrical main body portion 61, and a piston 62 urged by hydraulic pressure and a spring in a direction to project from the main body portion 61. A spherical recess 62*a* provided at the tip end of the piston 62 is relatively rotatably engaged with the spherical recess 22*a* of the rocker arm 22 (see FIG. 3).

The subsidiary cam 21 is rockably supported on the movable support shaft 20 extending between the pair of sidewalls 27, 27 of the control arm 17. The subsidiary cam 21 has a first arm 21*a* projecting from an axially central part thereof. A roller 41 is supported on the first arm 21*a* via a roller shaft 39 and a needle bearing 40 so as to abut the valve cam 14 provided on the cam shaft 15. The subsidiary cam 21 also has a pair of second arms 21*b*, 21*b* projecting from axially opposite ends thereof. Rollers 37, 37 of the rocker arms 22, 22 abuts on cam faces 21*c*, 21*c* formed on the second arms 21*b*, 21*b*.

An urging means 42 is attached to an urging-means mounting hole 29*a* formed in the connecting wall portion 29 of the control arm 17. The urging means 42 generates an urging force for bringing the roller 41 of the subsidiary cam 21 into contact with the valve cam 14. The urging means 42 comprises: a guide cylinder 43 press-fitted into the urging-means mounting hole 29*a* in the connecting wall portion 29; a pushing member 44 slidably fitted in the guide cylinder 43; a contact portion 45 provided at the upper end of the pushing member 44 so as to abut on a lower face of the first arm 21*a* of the subsidiary cam 21; a coil spring 46 provided under compression between the guide cylinder 43 and the contact portion 45 so as to urge the pushing member 44 in the projecting direction.

Figure 3:
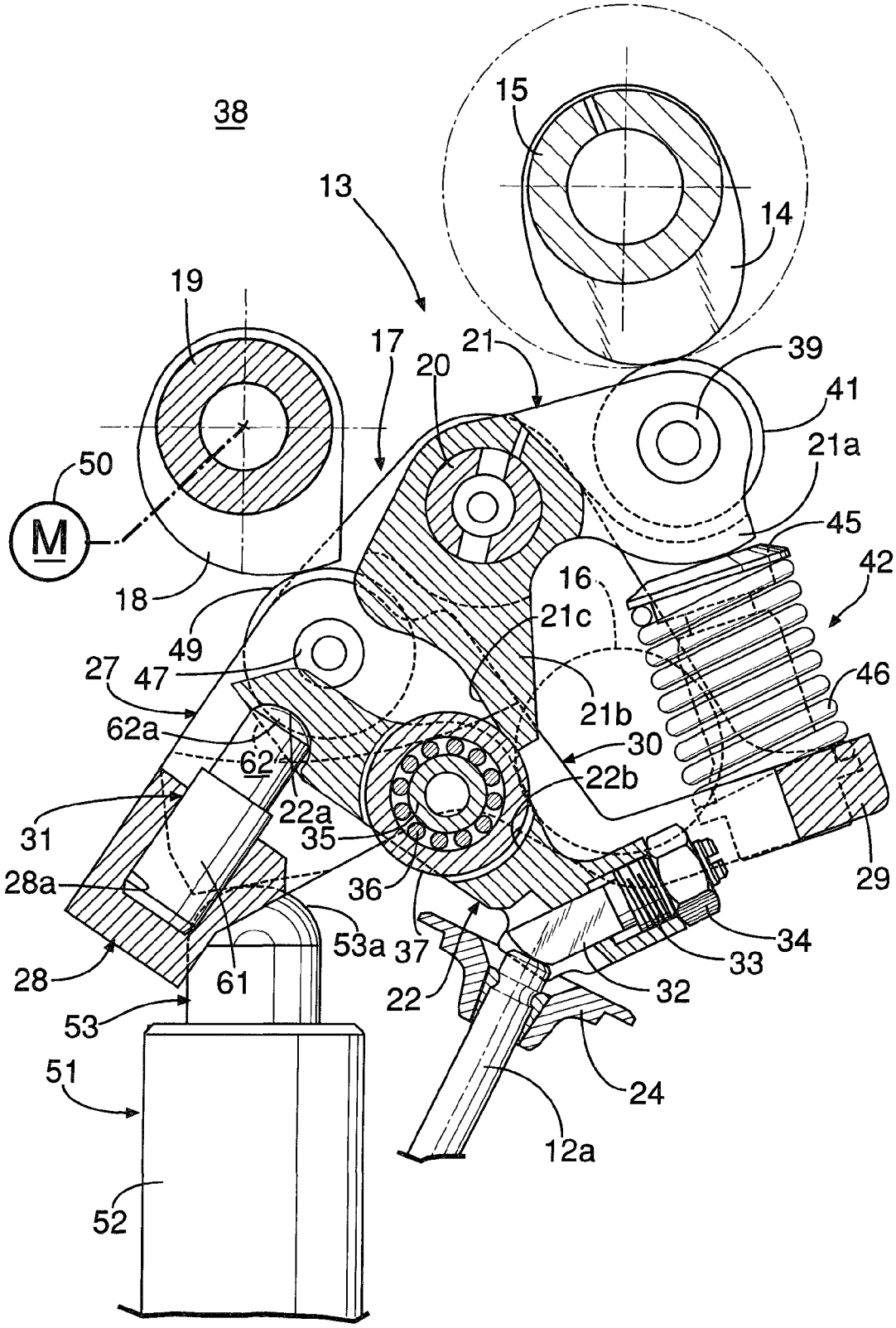
Figure 4:
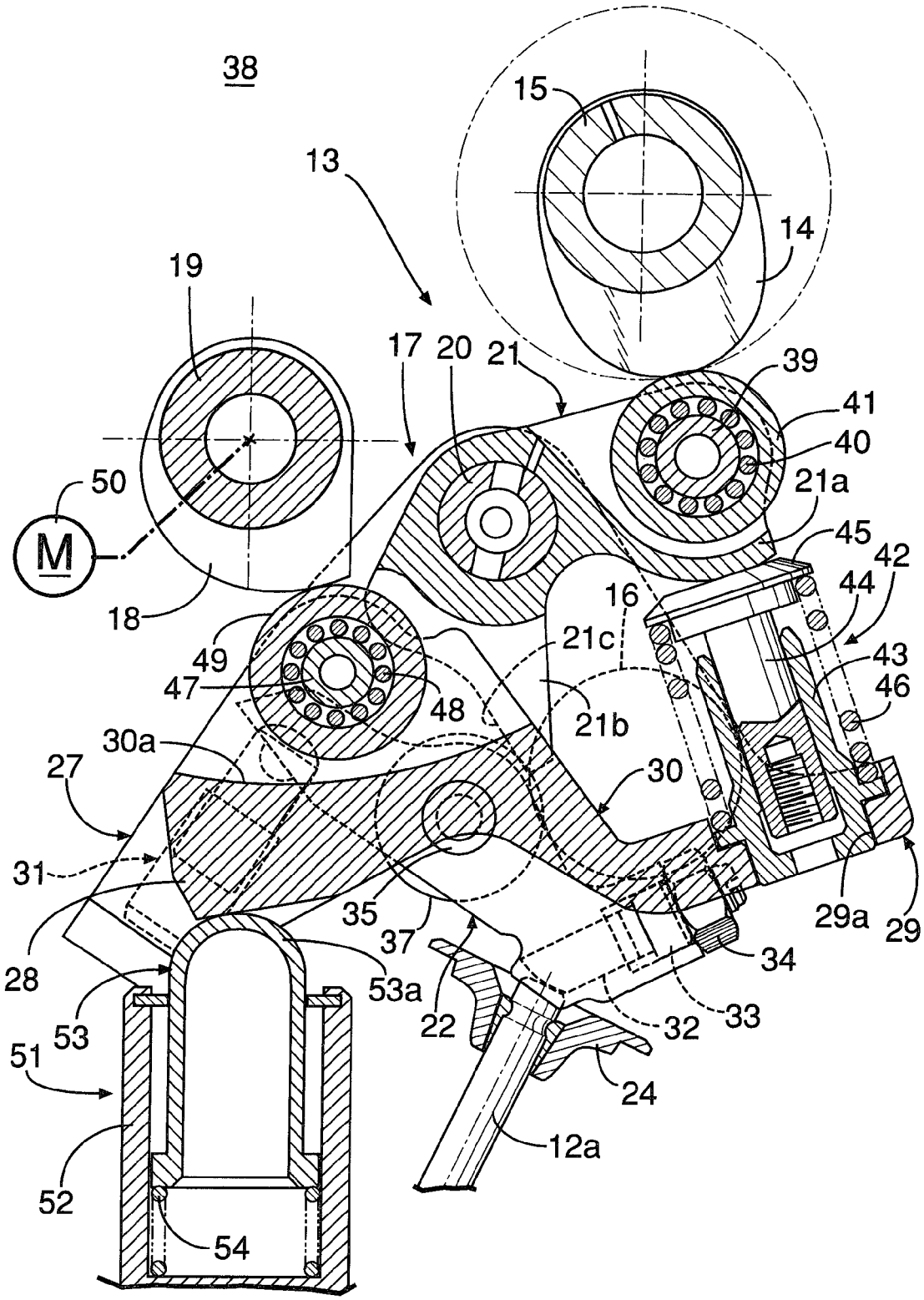
Figure 5:
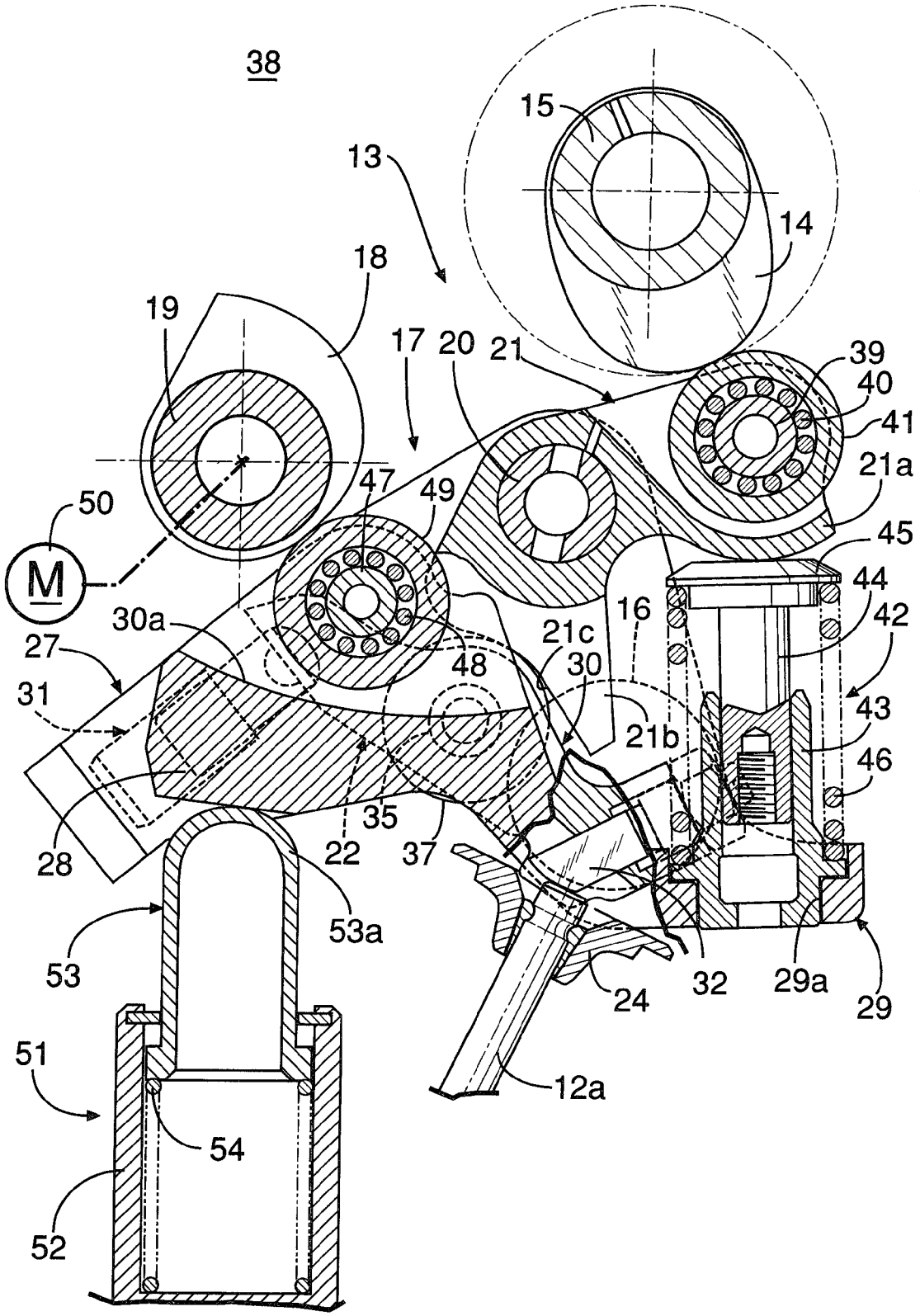
Figure 6:
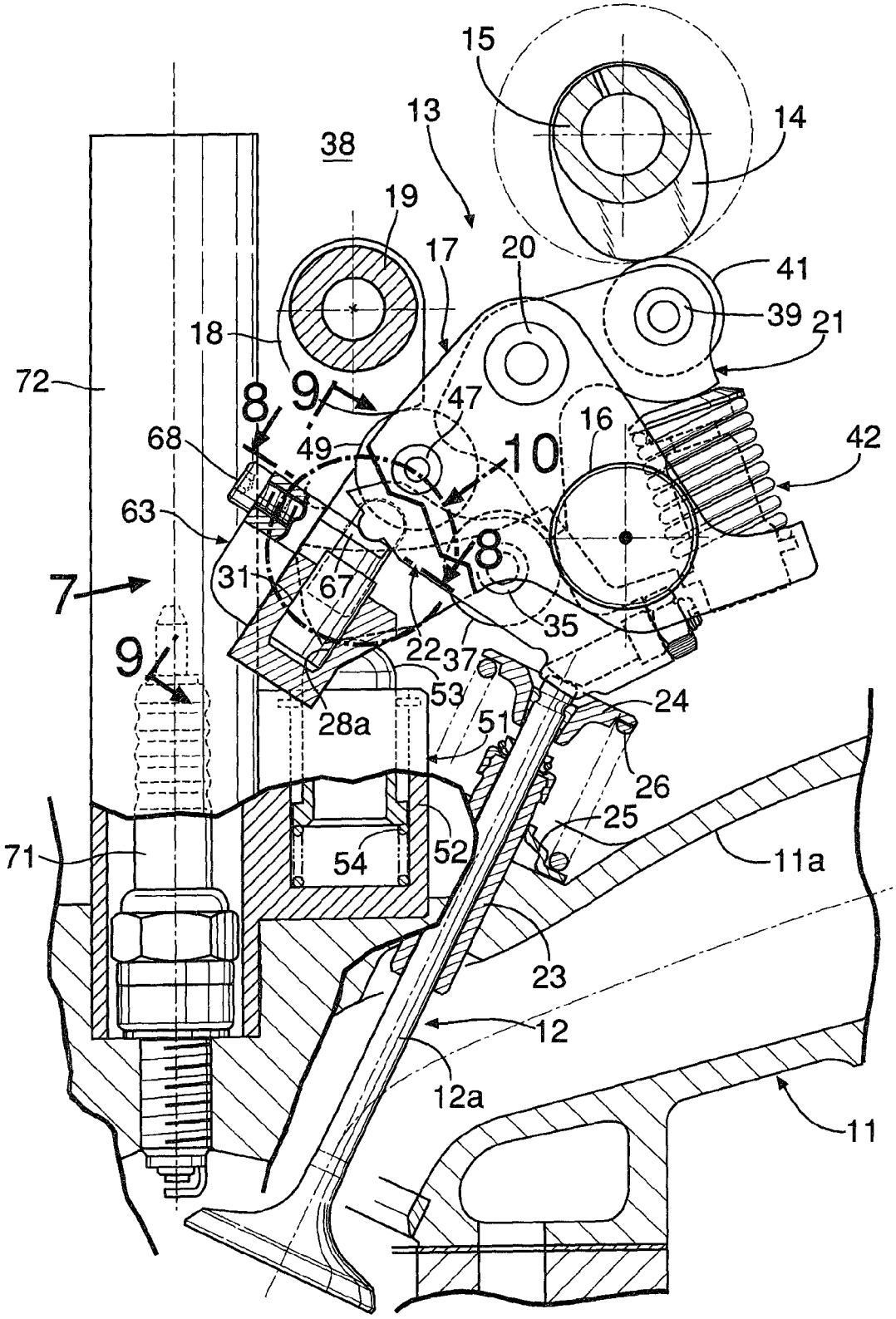
Figure 7:
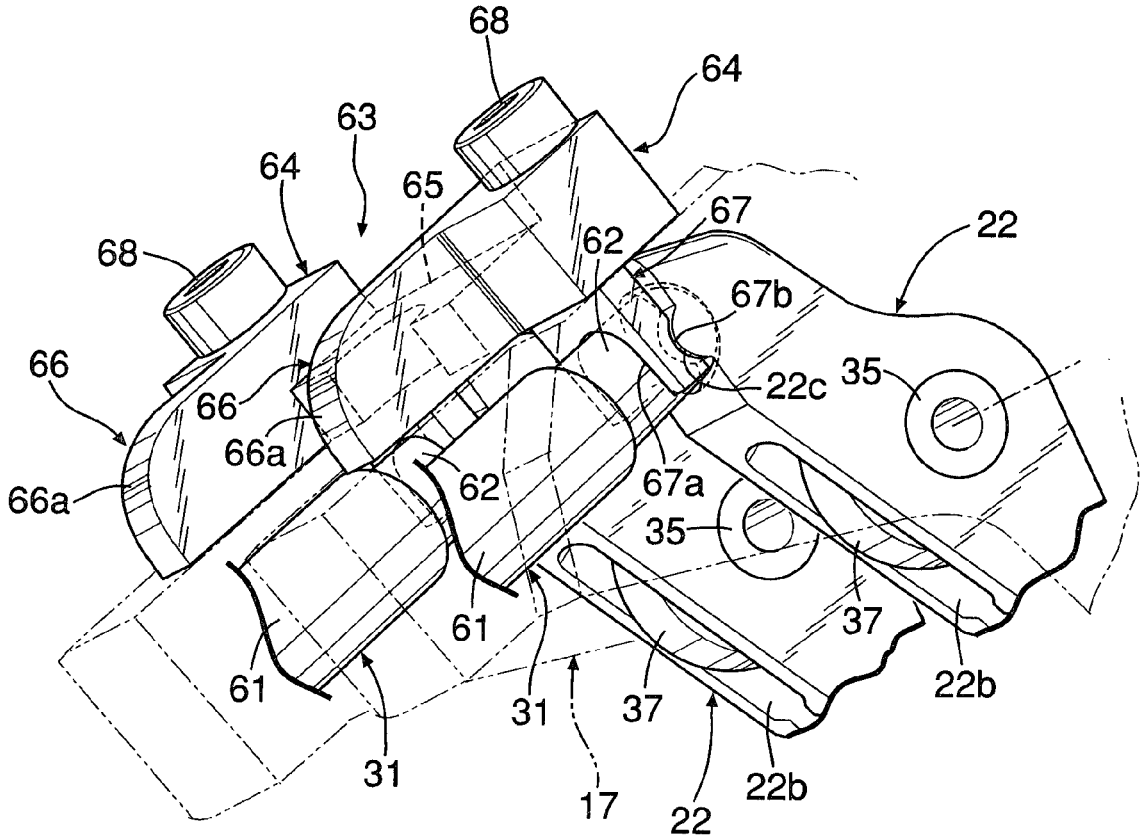
Figure 8:
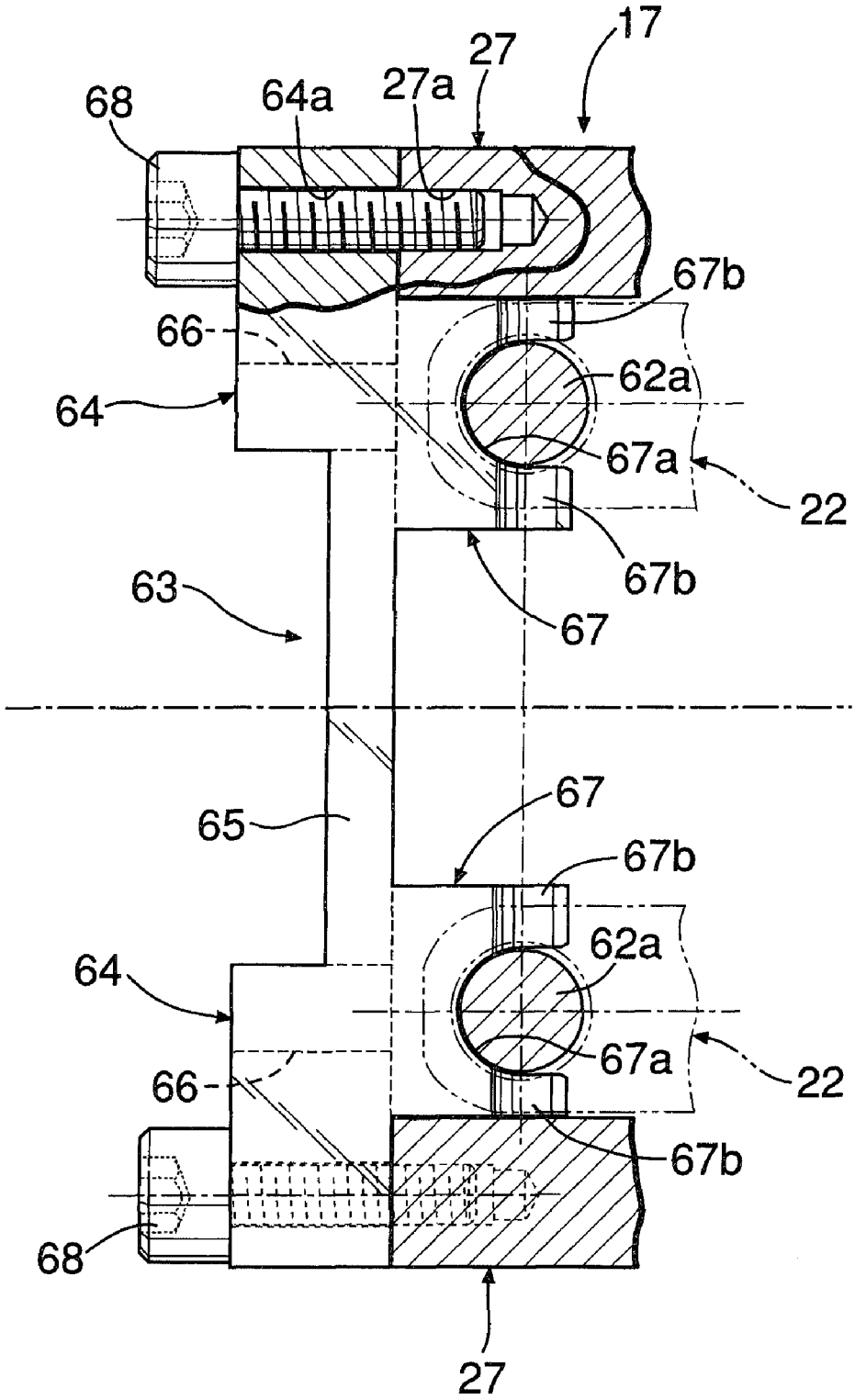
Figure 9:
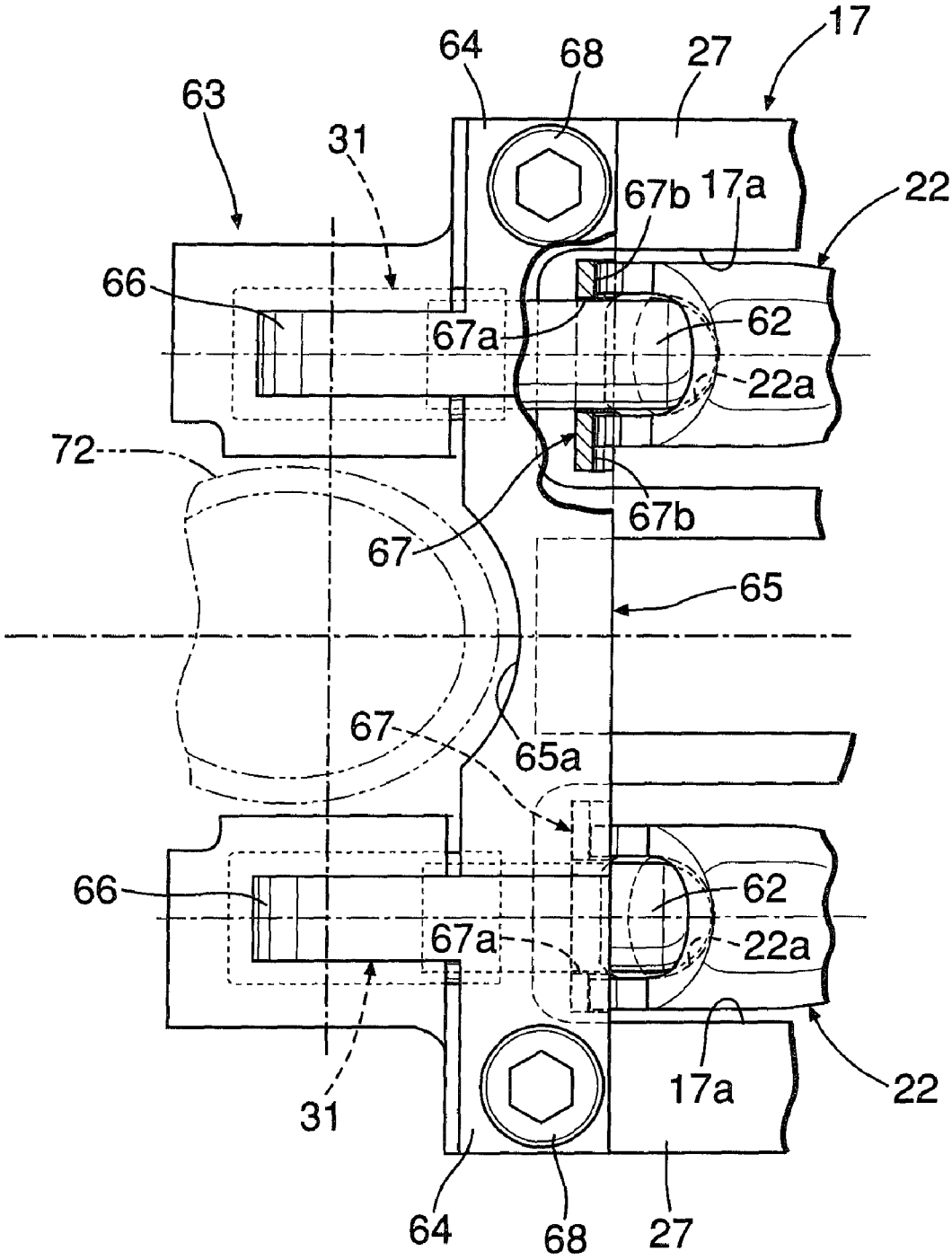
Figure 10:
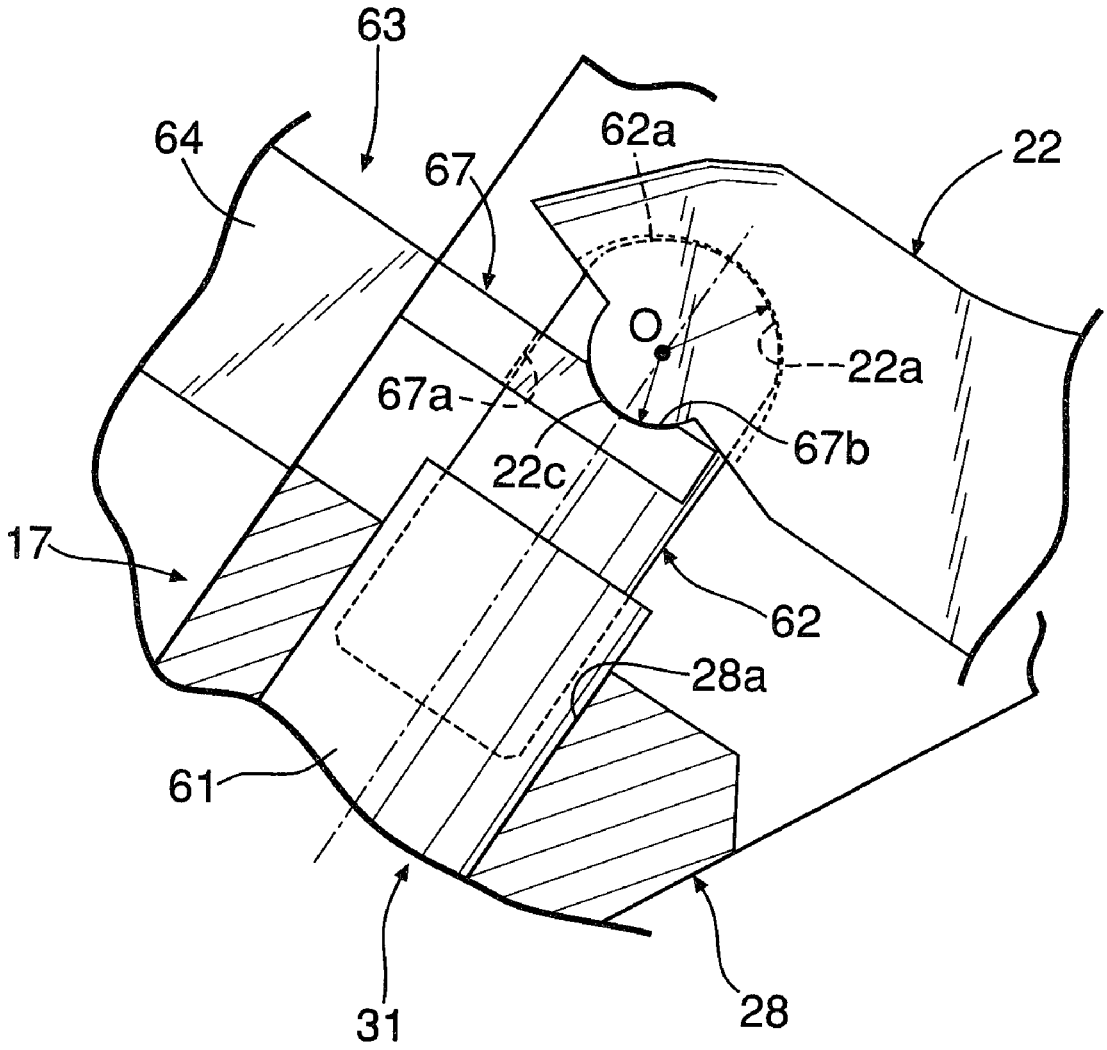

A roller accommodating recess 30*a* is formed at the center of the bulkhead portion 30 of the control arm 17. A roller 49 is rotatably supported via a needle bearing 48 on a roller shaft 47 which extends over the recess 30*a*. In order to push the roller 49 to rock the control arm 17 around the support shaft portions 16, 16, the control cam 18 which has a cam face comprising an involute curve is provided on the control shaft 19 which is rotatingly reciprocated by an actuator 50 comprising an electric motor. In FIGS. 3 to 5, when the control shaft 19 is rotated in the clockwise direction, the control arm 17 is rocked in the counterclockwise direction around the support shaft portions 16, 16; and when the control shaft 19 is rotated in the counterclockwise direction, the control arm 17 is rocked in the clockwise direction around the support shaft portions 16, 16.

In order to urge the control arm 17 in the clockwise direction to bring the roller 49 into contact with the control cam 18, an urging means 51 is provided in the cylinder head 1. The urging means 51 causes a pushing member 53 to be slidably fitted into a guide cylinder 52 which is press-fitted into the cylinder head 11. The urging means 51 urges the pushing member 53 by use of a resilient force of a coil spring 54 in a direction in which the pushing member 53 projects from the guide cylinder 52. A spherical projection 53*a* is provided at the upper end of the pushing member 53 so as to abut on a central portion in a lower face of an end wall 28 of the control arm 17.

Next, based on FIGS. 6 to 11, a structure of a jig 63 for adjusting the lift amount of the intake valves 12, 12 will be described.

Figure 11:
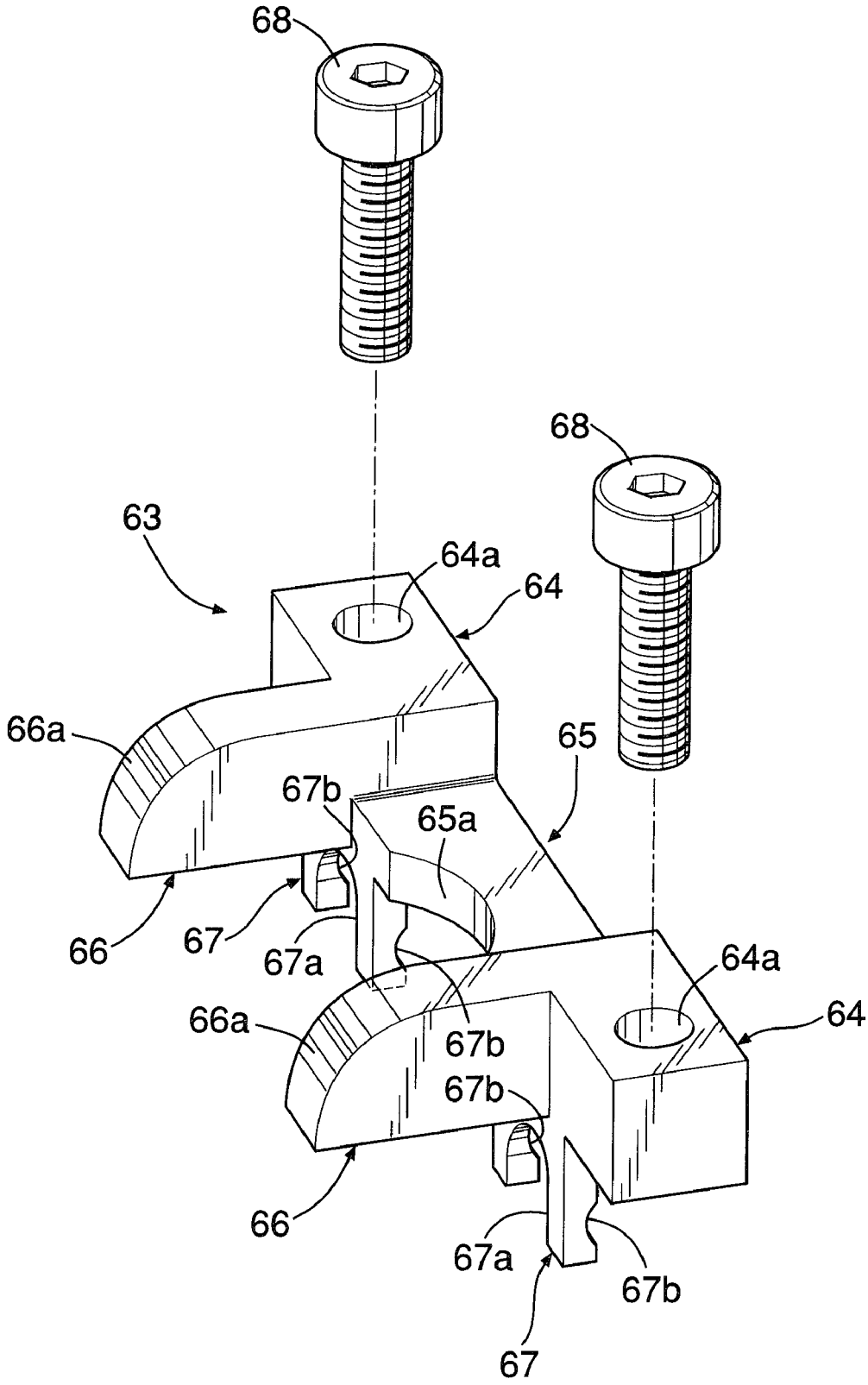

As apparent from FIG. 11, the jig 63 comprises: a pair of fixed portions 64, 64; a pair of long holes 64*a*, 64*a* formed in the fixed portions 64, 64, respectively; a connecting portion 65 connecting the fixed portions 64, 64 to each other so as to form a bridge therebetween; an arc-shaped notch 65*a* formed in the connecting portion 65; a pair of pushed portions 66, 66 projecting from the fixed portions 64, 64, respectively; a pair of arc-shaped cam faces 66*a*, 66*a* formed in the pushed portions 66, 66, respectively; a pair of rocker arm lock portions 67, 67 projectingly provided over the fixed portions 64, 64 and the connecting portion 65; and an arc-shaped notch 67*a* formed in each rocker arm lock portion 67; and two receiving portions 67*b*, 67*b* recessed in each rocker arm lock portion 67.

As apparent from FIGS. 6 to 10, the jig 63 is fixed to two bolt holes 27*a*, 27*a* (see FIGS. 2 and 8) formed in the upper faces of the pair of sidewalls 27, 27 of the control arm 17 by two bolts 68, 68 penetrating the long holes 64*a*, 64*a* in the pair of fixed portions 64, 64.

A spherical recess 22*a* is formed in the rocker arm 22. The spherical projection 62*a* at the tip end of the piston 62 of the hydraulic tappet 31 is relatively rotatably engaged with the spherical recess 22*a*. Arc-shaped projections 22*c*, 22*c* are provided on opposite sides of the spherical recess 22*a* so as to rockably engage with the arc-shaped receiving portions 67*b*, 67*b* of the rocker arm lock portion 67. A center point O, around which the arc-shaped receiving portions 67*b*, 67*b* and the arc-shaped projections 22*c*, 22*c* are relatively rotated, corresponds to a center point O around which the spherical projection 62*a* of the piston 62 and the spherical recess 22*a* of the rocker arm 22 are relatively rotated (see FIG. 10). Therefore, the rocker arms 22, 22 pivotally supported by the jig 63 can rock around the center point O as in the case where they are pivotally supported by the hydraulic tappets 31, 31.

The pistons 62, 62 of the hydraulic tappets 31, 31 pass through the arc-shaped notches 67*a*, 67*a* in the rocker arm lock portions 67, 67 of the jig 63 with a small clearance between the pistons 62, 62 and the notches 67*a*, 67*a*. Therefore, the jig 63 never contacts the hydraulic tappets 31, 31.

Next, the operation of the first embodiment of the present invention having the above-described structure.

First, the operation of the lift-variable valve-operating mechanism 13 will be described. When the control arm 17 is arranged at a position shown in FIGS. 3 and 4 by the control cam 18, that is, when the highest lift portion of the control cam 18 abuts the roller 49, tip ends (on the side far from the movable support shaft 20) of the cam faces 21*c*, 21*c* of the subsidiary cam 21 rocking around the axis of the movable support shaft 20 abuts the rollers 37, 37 of the rocker arms 22, 22 to increase a rocking angle of the rocker arms 22, 22, thereby maximizing the lift amount of the intake valves 12, 12.

Also, when the control arm 17 is at a position shown in FIG. 5 by the control cam 18, that is, when the lowest lift portion of the control cam 18 abuts roller 49, the base ends (on the side closer to the movable support shaft 20) of the cam faces 21*c*, 21*c* of the subsidiary cam 21 rocking around the axis of the movable support shaft 20 abuts rollers 37, 37 of the rocker arms 22, 22 to decrease the rocking angle of the rocker arms 22, 22, thereby minimizing the lift amount of the intake valves 12, 12 (to zero).

As described above, the control arm 17 is rocked around the support shaft portions 16, 16 to change the lift amount of the intake valves 12, 12, and further the drive of the control arm 17 also changes the timing when the valve cams 14, 14 contact the rollers 41, 41, thereby changing the opening/closing timing of the intake valves 12, 12.

Next, the procedure of adjusting the lift amount of the intake valves 12, 12 will be described.

Because the adjustment of the lift amount of the intake valves 12, 12 is conducted while the internal combustion engine is stopped and the hydraulic pump is not operated, the hydraulic tappets 31, 31 urging the rocker arms 22, 22 are not operated. Thus, it is impossible to press the roller 37 provided at each rocker arm 22 onto the subsidiary cam 21, or press the valve driving member 32 provided at each rocker arm 22 onto the stem 12*a* of the intake valve 12. In this state, it is impossible to adjust the lift amount of the intake valves 12, 12.

Then, the jig 63 is fixed to the control arm 17 by the two bolts 68, 68, and the receiving portions 67*b*, 67*b* of each rocker arm lock portion 67 of the jig 63 are engaged with the projections 22*c*, 22*c* of the rocker arm 22. At this time, an operator pushes the jig 63 in the upper right direction in FIG. 6 by hand so that the roller 37 of the rocker arm 22 is brought into close contact with the subsidiary cam 21 without any gap therebetween and so that the valve driving member 32 of the rocker arm 22 is brought into close contact with the stem 12*a* of the intake valve 12 without any gap therebetween, and the operator moves the jig 63 within the ranges of the long holes 64*a*, 64*a*, and fixes the jig 63 to the control arm 17 by the two bolts 68, 68 passed through the long holes 64*a*, 64*a* at predetermined positions.

In this state, the spherical projection 62*a* at the tip end of the piston 62 of each hydraulic tappet 31 is engaged with the spherical recess 22*a* of the rocker arm 22. However, hydraulic pressure is not supplied to the hydraulic tappet 31, and thus when a load acts on the piston 62 of the hydraulic tappet 31, the piston 62 is pushed into the main body portion 61 without establishing a rocking fulcrum of the rocker arm 22. In the first embodiment, in place of the hydraulic tappet 31, the receiving portions 67*b*, 67*b* of each rocker arm lock portion 67 of the jig 63 and the projections 22*c*, 22*c* of the rocker arm 2 are engaged with each other to establish the rocking fulcrum of the rocker arm 22. Therefore, the rocker arms 22, 22 can rock around the center point O as in the case where they are pivotally supported by the hydraulic tappets 31, 31.

In this state, if the control shaft 19 is fixed at the predetermined position and the cam shaft 15 is rotated by an external force, the intake valves 12, 12 are lifted through the subsidiary cam 21 and the rocker arms 22, 22, and then it is checked by a measuring device (not shown) whether the lift amount corresponds to a specified value. If the lift amount deviates from the specified value, the lift amount of the intake valves 12, 12 is adjusted so as to match the specified value by rotating adjust screws 33, 33 to move the valve driving members 32, 32 back and forth.

As described above, according to the first embodiment, the adjustment of the lift amount of the intake valves 12, 12 can be performed without any problem by use of the jig 63 which directly abuts rocker arms 22, 22 to establish their rocking fulcrum, without fixing with a jig the pistons 62, 62 of the hydraulic tappets 31, 31 which are not exerting their function due to stoppage of the hydraulic pump. Further, a load acting on the rocker arms 22, 22 during the adjustment of the lift amount is supported by the jig 63 and is not transmitted to the hydraulic tappets 31, 31. Therefore, the hydraulic tappets 31, 31 can be protected from damage without being particularly reinforced, thereby contributing to downsizing and improvement in durability of the hydraulic tappets 31, 31.

Also, the rocking fulcrum of the rocker arms 22, 22 by the jig 63 is established by engagement between the projections 22*c*, 22*c* provided at each rocker arm 22 and the receiving portions 67*b*, 67*b* provided at each rocker arm lock portion 67 of the jig 63, thereby reliably pivotally supporting the rocker arm 22 without slip. Particularly, the projections 22*c*, 22*c* of the rocker arm 22 and the receiving portions 67*b*, 67*b* of the jig 63 comprise arc-shaped faces which are rockably engaged with each other; and the center of the arc-shaped faces and the center of the spherical projection 62*a* at the tip end of the piston 62 of the hydraulic tappet 31 are aligned with each other when seen in a direction orthogonal a rocking face of the rocker arm 22. Therefore, the rocker arms 22, 22 can rock around the same center point as in the state where they are pivotally supported by the hydraulic tappets 31, 31, thereby improving accuracy in adjustment of the lift amount of the intake valves 12, 12.

Further, because the jig 63 is mounted on the control arm 17 rockably supporting the subsidiary cam 21 and the rocker arms 22, 22, the positional relationship between the jig 63 and the rocker arms 22, 22 is made constant, thereby pivotally supporting the rocker with a good accuracy. Furthermore, because the jig 63 is mounted so as to provide connection between the pair of sidewalls 27, 27 of the control arm 17, the jig 63 enhances the rigidity of the control arm 17, thereby preventing distortion of the control arm 17 to improve the accuracy in adjustment of the lift amount of the intake valves 12, 12.

Moreover, the jig 63 is provided with the notch 65*a* at the connecting portion 65, thereby avoiding interference between the jig 63 and the ignition plug guide cylinder 72 which serves as a guide in the process of attachment/detachment of the ignition plug 71. Therefore, it is possible to mount the jig 63 in a small space without any problem (see FIG. 9).

Figure 12:
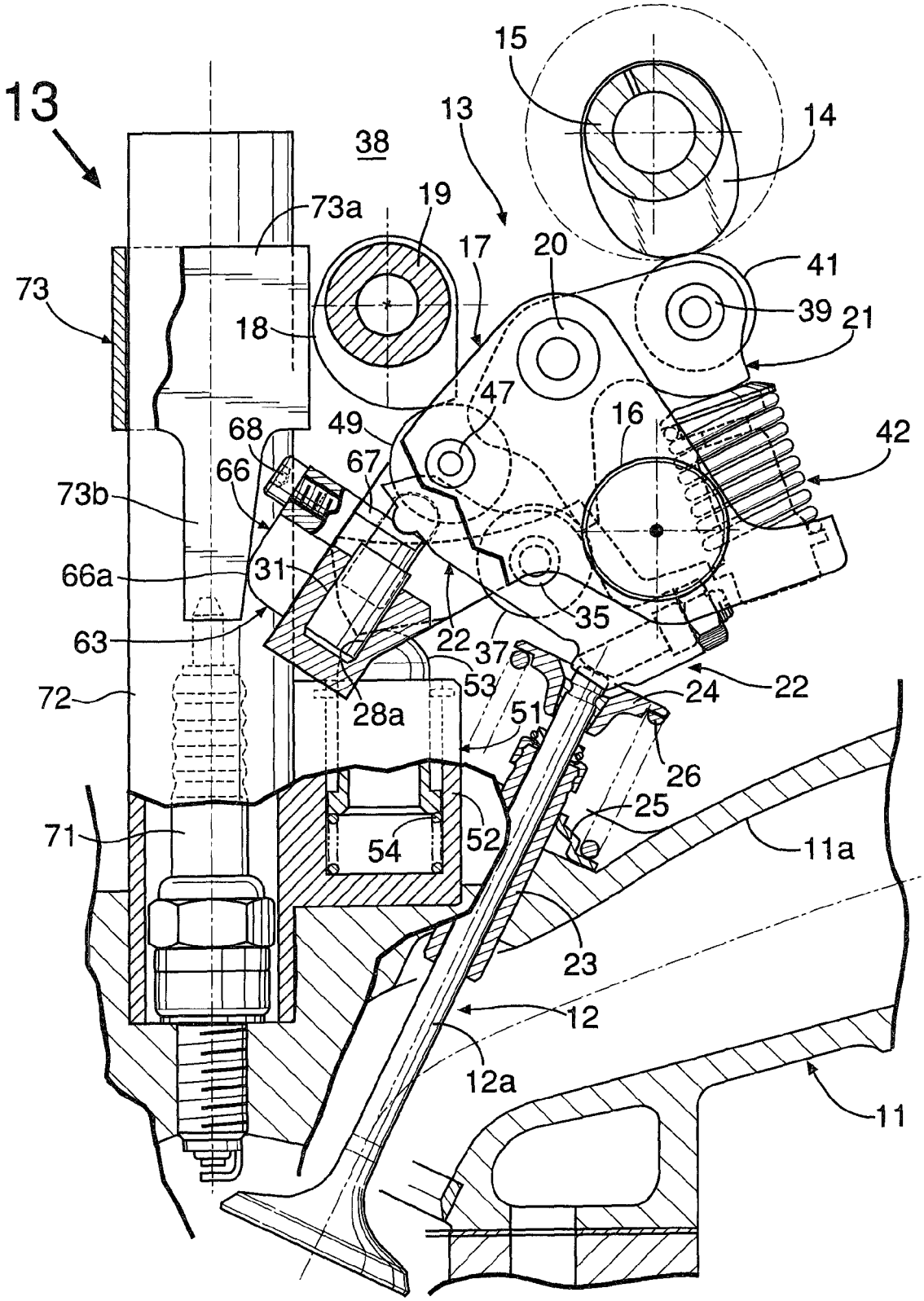
Figure 13:
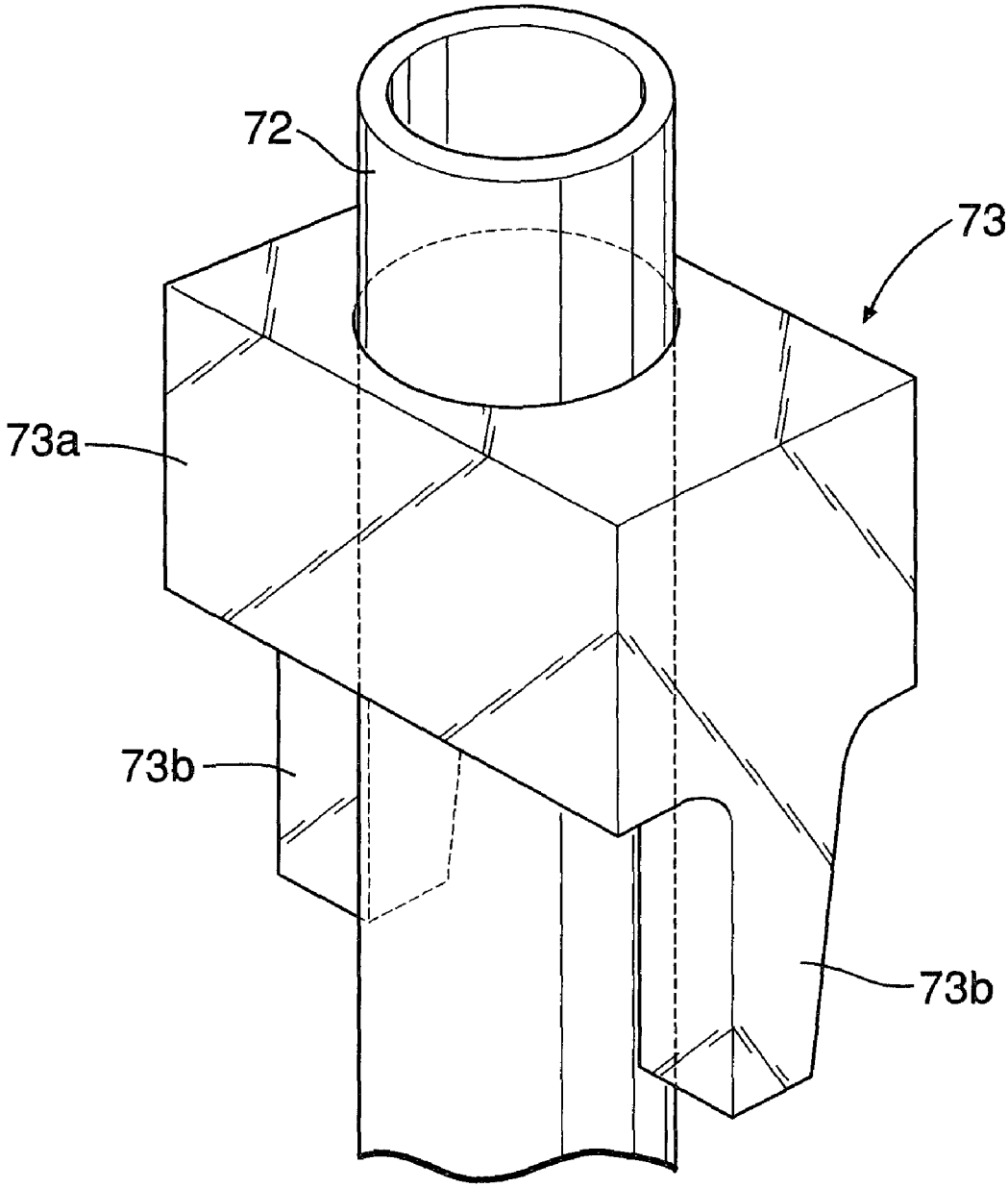

Next, a second embodiment of the present invention will be described based on FIGS. 12 and 13.

In the above-described first embodiment, in the process of mounting the jig 63 to the control arm 17, the operator pushes the jig 63 against the rocker arms 22, 22, and in this state the jig 63 is fixed to the control arm 17 by the two bolts 68, 68 so that the roller 37 of each rocker arm 22 is brought into close contact with the subsidiary cam 21 without any gap therebetween and so that the valve driving member 32 of each rocker arm 22 is brought into close contact with the stem 12*a* of the intake valve 12 without any gap therebetween. However, in the second embodiment, the jig 63 is pushed against the rocker arms 22, 22 with a constant load by use of a weight member 73.

More specifically, the weight member 73 comprises: a weight portion 73*a* slidably fitted to the outer periphery of the ignition plug guide cylinder 72; and a pair of pushing portions 73*b*, 73*b* projecting downward from the weight portion 73*a*. The lower ends of the pushing portions 73*b*, 73*b* abut on inclined cam faces 66*a*, 66*a* of the pair of pushed portions 66, 66 of the jig 63. Therefore, the jig 63 is urged by a constant load while the cam faces 66*a*, 66*a* of the pushed portions 66, 66 are pushed by the pushing portions 73*b*, 73*b* of the weight member 73. In this state, the jig 63 is fixed to the control arm 17 by the volts 68, 68, thereby improving the operability and accuracy in adjustment of the lift amount of the intake valves 12, 12.

The embodiments of the present invention have been described above, but various changes in design may be made without departing from the subject matter of the present invention.

For example, the structure of the lift-variable valve-operating mechanism 13 is not limited to those of the embodiments, and any structure can be employed as long as the rocker arm 22 is provided therein.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

I claim:

1. A lift amount adjusting device in a valve-operating mechanism which changes at least a lift amount, the valve-operating mechanism comprising:

a valve cam;

an engine valve;

a driving-force transmitting path which transmits a driving force of the valve cam to the engine valve;

a rocker arm rockably arranged in the driving-force transmitting path; and a hydraulic tappet which adjusts a clearance of the driving-force transmission path by urging the rocker arm, the lift amount adjusting device comprising a jig which abuts the rocker arm to establish a rocking fulcrum in place of the hydraulic tappet.

2. The lift amount adjusting device in a valve-operating mechanism which changes at least a lift amount according to claim 1, wherein the rocking fulcrum is established by engagement between a projection provided in the rocker arm and a receiving portion provided in the jig.

3. The lift amount adjusting device in a valve-operating mechanism which changes at least a lift amount according to claim 2, wherein the projection and the receiving portion comprise arc-shaped faces which are rockably engaged with each other; and a center of the arc-shaped faces and a center of a spherical projection at a tip end of a piston of the hydraulic tappet are aligned with each other when seen in a direction orthogonal a rocking face of the rocker arm.

4. The lift amount adjusting device in a valve-operating mechanism which changes at least a lift amount according to any of claims 1 to 3, wherein the valve-operating mechanism includes a control arm which rockably supports a subsidiary cam and the rocker arm, and the jig is mounted to the control arm.

5. The lift amount adjusting device in a valve-operating mechanism which changes at least a lift amount according to claim 4, wherein the control arm includes a plurality of rocker-arm accommodating holes for accommodating a plurality of rocker arms; and the jig abuts the plurality of rocker arms and mounted so as to provide connection between sidewalls of the plurality of rocker-arm accommodating holes.

6. The lift amount adjusting device in a valve-operating mechanism which changes at least a lift amount according to any of claims 1 to 3, wherein the jig has a notch for avoiding interference with an ignition plug guide cylinder.

7. The lift amount adjusting device in a valve-operating mechanism which changes at least a lift amount according to any of claims 1 to 3, wherein the jig abuts a weight member slidably fitted in the ignition plug guide cylinder to urge the rocker arm in a direction to adjust the clearance of the driving-force transmission path.

* * * * *